US011077479B2

(12) United States Patent
Moriyasu et al.

(10) Patent No.: US 11,077,479 B2
(45) Date of Patent: Aug. 3, 2021

(54) PRESSING DEVICE AND METHOD FOR CONTROLLING PRESSING DEVICE

(71) Applicant: KOMATSU INDUSTRIES CORPORATION, Kanazawa (JP)

(72) Inventors: Takashi Moriyasu, Komatsu (JP); Masaaki Kashiwa, Komatsu (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 216 days.

(21) Appl. No.: 16/348,693

(22) PCT Filed: Nov. 1, 2017

(86) PCT No.: PCT/JP2017/039595

§ 371 (c)(1),
(2) Date: May 9, 2019

(87) PCT Pub. No.: WO2018/123260

PCT Pub. Date: Jul. 5, 2018

(65) Prior Publication Data

US 2019/0283105 A1 Sep. 19, 2019

(30) Foreign Application Priority Data

Dec. 28, 2016 (JP) ..... JP2016-256088

(51) Int. Cl.
*B21D 43/02* (2006.01)
*B21D 37/04* (2006.01)
(Continued)

(52) U.S. Cl.
CPC ..... *B21D 37/04* (2013.01); *B21D 43/00* (2013.01); *B21D 43/02* (2013.01); *B21D 43/05* (2013.01); *B30B 13/00* (2013.01); *B30B 15/30* (2013.01)

(58) Field of Classification Search
CPC ..... B21D 37/04; B21D 43/02; B21D 43/05; B21D 43/055; B21D 43/057; B21D 43/052; B65G 25/02; B30B 15/30
See application file for complete search history.

(56) References Cited

U.S. PATENT DOCUMENTS 3,969,918 A * 7/1976 Bernotus ..... B21D 28/06 72/337
4,160,372 A 7/1979 Bergman et al.
(Continued)

FOREIGN PATENT DOCUMENTS

CN 1532045 A 9/2004
CN 105344855 A 2/2016
(Continued)

OTHER PUBLICATIONS

The Office Action for the corresponding Chinese application No. 201780062749.0, dated Jun. 2, 2020.
(Continued)

*Primary Examiner* — Edward T Tolan
(74) *Attorney, Agent, or Firm* — Global IP Counselors, LLP

(57) ABSTRACT

A pressing device is capable of selectively pressing either a coiled material or a sheet material. The pressing device includes a pair of bars and a first retracting mechanism. Each bar includes a holding section capable of holding the sheet material, a first end section separably linked to the holding section on an upstream side of the holding section along a conveyance direction of a material, and a second end section separably linked to the holding section on a downstream side of the holding section along the conveyance direction. The first retracting mechanism is configured to move the first end sections to an upper first retracted position during the pressing of the coiled material.

13 Claims, 12 Drawing Sheets

(51) Int. Cl.

| | |
|---|---|
| ***B21D 43/05*** | (2006.01) |
| ***B21D 43/00*** | (2006.01) |
| ***B30B 15/30*** | (2006.01) |
| ***B30B 13/00*** | (2006.01) |

(56) References Cited

U.S. PATENT DOCUMENTS

| | | | | |
|---|---|---|---|---|
| 4,368,022 | A * | 1/1983 | Orii | B65G 25/06 425/343 |
| 5,231,860 | A * | 8/1993 | Tsuruta | B21D 43/055 72/20.1 |
| 5,423,202 | A * | 6/1995 | Komatsu | B21D 43/055 483/14 |
| 5,771,561 | A * | 6/1998 | Hofele | B21D 43/057 29/563 |
| 6,192,285 | B1 * | 2/2001 | Takayama | B21D 43/055 318/34 |
| 6,622,850 | B2 * | 9/2003 | Noda | B65G 25/02 198/621.1 |
| 7,448,489 | B2 * | 11/2008 | Reichenbach | B21D 43/055 198/621.1 |
| 7,690,238 | B2 * | 4/2010 | Shiroza | B21D 43/055 72/405.11 |
| 8,857,239 | B2 * | 10/2014 | Nishida | B21D 43/057 72/405.11 |
| 2008/0034988 | A1 | 2/2008 | Shiroza | |
| 2016/0243778 | A1 | 8/2016 | Imaeda et al. | |

FOREIGN PATENT DOCUMENTS

| | | | |
|---|---|---|---|
| CN | 105593009 | A | 5/2016 |
| JP | 62-146530 | U | 9/1987 |
| JP | 5-13622 | U | 2/1993 |
| JP | 9-136199 | A | 5/1997 |
| JP | 2004-9136 | A | 1/2004 |
| JP | 2005-153016 | A | 6/2005 |
| JP | 2006-224165 | A | 8/2006 |
| KR | 20090006611 | U | 7/2009 |

OTHER PUBLICATIONS

The International Search Report for the corresponding international application No. PCT/JP2017/039595, dated Jan. 16, 2018.

* cited by examiner

PRESSING DEVICE AND METHOD FOR CONTROLLING PRESSING DEVICE

CROSS-REFERENCE TO RELATED APPLICATIONS

This application is a U.S. National stage application of International Application No. PCT/JP2017/039595, filed on Nov. 1, 2017. This U.S. National stage application claims priority under 35 U.S.C. § 119(a) to Japanese Patent Application No. 2016-256088, filed in Japan on Dec. 28, 2016, the entire contents of which are hereby incorporated herein by reference.

BACKGROUND

Field of the Invention

The present invention relates to a pressing device and a method for controlling a pressing device.

Background Information

Pressing devices that have been used for performing pressing include the use of a progressive die in which a coiled material is used, and the use of a transfer die in which a sheet material is used.

With a progressive die, the coiled material is supplied from a coil line having an uncoiler, a leveler, a feeder, and so forth to a pressing device (see, for example, JP-A 2006-224165). With a coil line, the coiled material played out from the uncoiler device is corrected for curl by the leveler, and is intermittently fed to the pressing device by the feeder. A plurality of dies are installed in the pressing device, and the coiled material intermittently fed by the feeder is pressed by these dies one after the other.

With a transfer die, a transfer feeder is provided inside the pressing device in order to sequentially convey sheet materials to the plurality of dies installed in the pressing device (see, for example, JP-A 2005-153016).

Meanwhile, there is a need for a pressing device that can use both a coiled material and a sheet material, and can therefore be used for both transfer and progressive feed. In this case, when performing the progressive feed pressing using the coiled material, the feeder needs to feed the 1 upstream of and near a bolster in the pressing device in order to perform the termination of the coiled material. The term "termination" refers to the feeding of the front end of the coiled material into the pressing device, and to the feeding of the rear end of the coiled material into the pressing device.

SUMMARY

However, with the above-mentioned dual-purpose pressing device, since a transfer bar is provided, interference with the transfer bar prevented the feeder from entering upstream of and near the bolster in the pressing device.

In order to move the feeder into the pressing device, it is conceivable to increase the width between the uprights and retract the transfer bar to the outside of the feeder, but this entails increasing the width of the pressing device more than necessary, so the device takes up more space and the cost goes up.

Given the above-mentioned problems encountered in the past, it is an object of the present invention to provide a pressing device and a pressing device control method with which of coiled materials and sheet materials can be pressed with a compact configuration.

The pressing device pertaining to an aspect of the invention is capable of selectively pressing either a coiled material or a sheet material, said pressing device comprising a pair of bars and a first retracting mechanism. The pair of bars has a holding section, a first end section, and a second end section. The holding section can hold a sheet material. The first end section is on the upstream side of the holding section in the conveying direction of the material and is detachable from the holding section. The second end section is on the downstream side of the holding section in the conveyance direction and is detachable from the holding section. The first retracting mechanism moves the first end section to an upper first retracted position in the pressing of a coiled material.

Also, the method for controlling a pressing device pertaining to another aspect of the invention is a method for controlling a pressing device capable of selectively pressing either a coiled material or a sheet material, said method comprising a first retraction step and a transmission step. The first retraction step involves moving the first end section of a pair of bars, which each have a holding section for holding a sheet material, a first end section that is separably linked to the holding section on the upstream side of the holding section in the conveyance direction of the material, and a second end section that is separably linked to the holding section on the downstream side of the holding section in the conveyance direction, to an upper first retracted position in the pressing of the coiled material. The transmission step involves transmitting a signal as a trigger for causing a feeder for supplying the coiled material to the pressing device to enter the pressing device once the first retraction step is complete.

The present invention provides a pressing device and a method for controlling a pressing device with which a coiled material and a sheet material can be pressed with a compact configuration.

DETAILED DESCRIPTION OF EMBODIMENT(S)

The press system in an embodiment of the present invention will now be described through reference to the drawings.

1. Configuration

1-1. Overview of Press System Configuration

Figure 1:
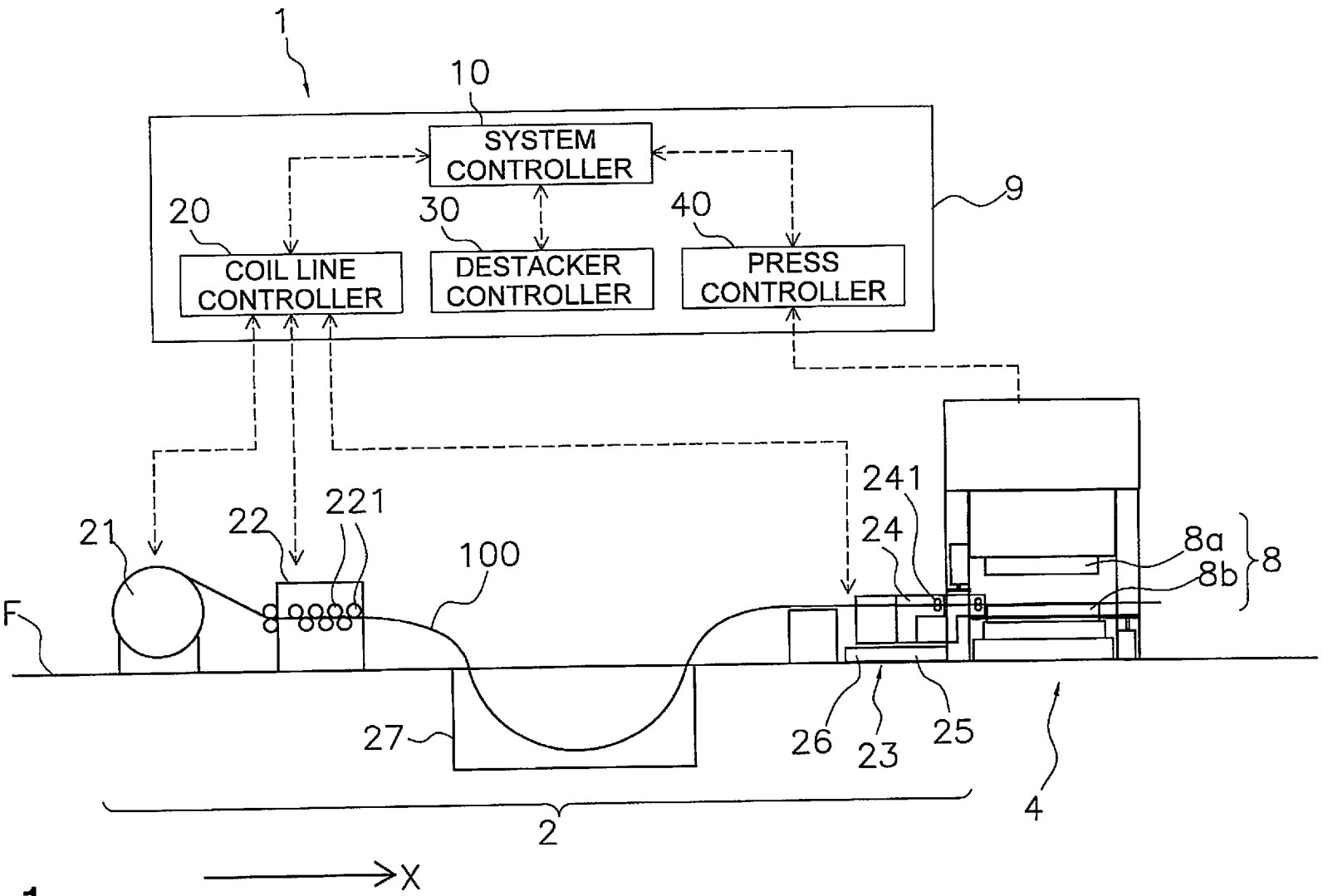
FIG. 1 is a side view of a press system in an embodiment of the present invention.
Figure 2:
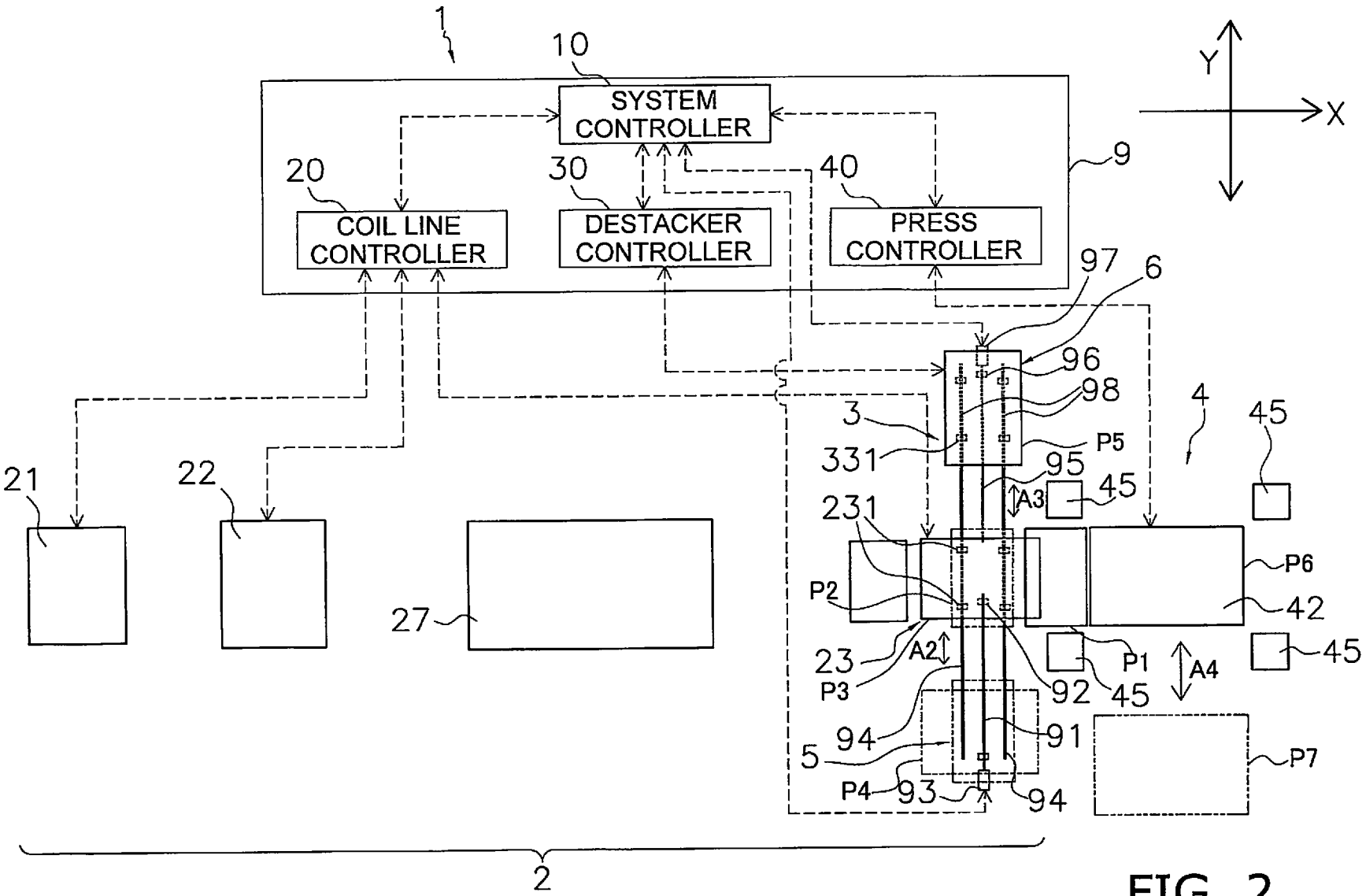
FIG. 2 is a plan view of the press system in FIG. 1.

FIG. 1 is a side view of a press system 1 in an embodiment of the present invention, and FIG. 2 is a plan view of FIG. 1.

The press system 1 in this embodiment can function both as a progressive die and a transfer die, and mainly comprises a coil line 2, a destacker unit 3 (see FIG. 2), a pressing device 4, a feeder unit movement mechanism 5, a destacker unit movement mechanism 6, and a system controller 10.

The coil line 2 supplies a coiled material 100 (see FIG. 1) to the pressing device 4. The destacker unit 3 supplies a sheet material 101 (see FIG. 4) to the pressing device 4. The pressing device 4 presses the coiled material 100 or the sheet material 101 to form a product. The pressing device 4 is equipped with a die 8 made up of an upper die 8*a* and a lower die 8*b*. Although not shown in the drawings, a plurality of dies are disposed in the pressing device 4 along the conveyance direction X.

In the pressing of the coiled material 100, the feeder unit movement mechanism 5 moves a feeder unit 23 (described below) to a usage position P3 upstream of and near the pressing device 4, and in the pressing of the sheet material 101, the feeder unit 23 is moved to a retracted position P4 that is away from the pressing device 4.

In the pressing of the sheet material 101 (described below), the destacker unit movement mechanism 6 moves the destacker unit 3 to the usage position P3 upstream of and near the pressing device 4, and in the pressing of the coiled material 100, the destacker unit 3 is moved to a retracted position P5 that is away from the pressing device 4.

The system controller 10 transmits and receives signals to and from a coil line controller 20 of the coil line 2, a destacker controller 30 of the destacker unit 3, and a press controller 40 of the pressing device 4 to control the entire press system 1. The system controller 10 also transmits and receives signals to and from the feeder unit movement mechanism 5 and the destacker unit movement mechanism 6.

The system controller 10, the coil line controller 20, the destacker controller 30, and the press controller 40 are provided to a control device 9. The control device 9 has a CPU, a memory, a display, and an input component (a keyboard, buttons, etc.).

1-2. Coil Line

The coil line 2 has an uncoiler 21, a leveler 22, the feeder unit 23, and the coil line controller 20. The uncoiler 21 unwinds and plays out the wound coiled material 100. The leveler 22 has a plurality of rollers 221, and corrects the winding curl of the coiled material 100 passing between the rollers 221.

Figure 3:
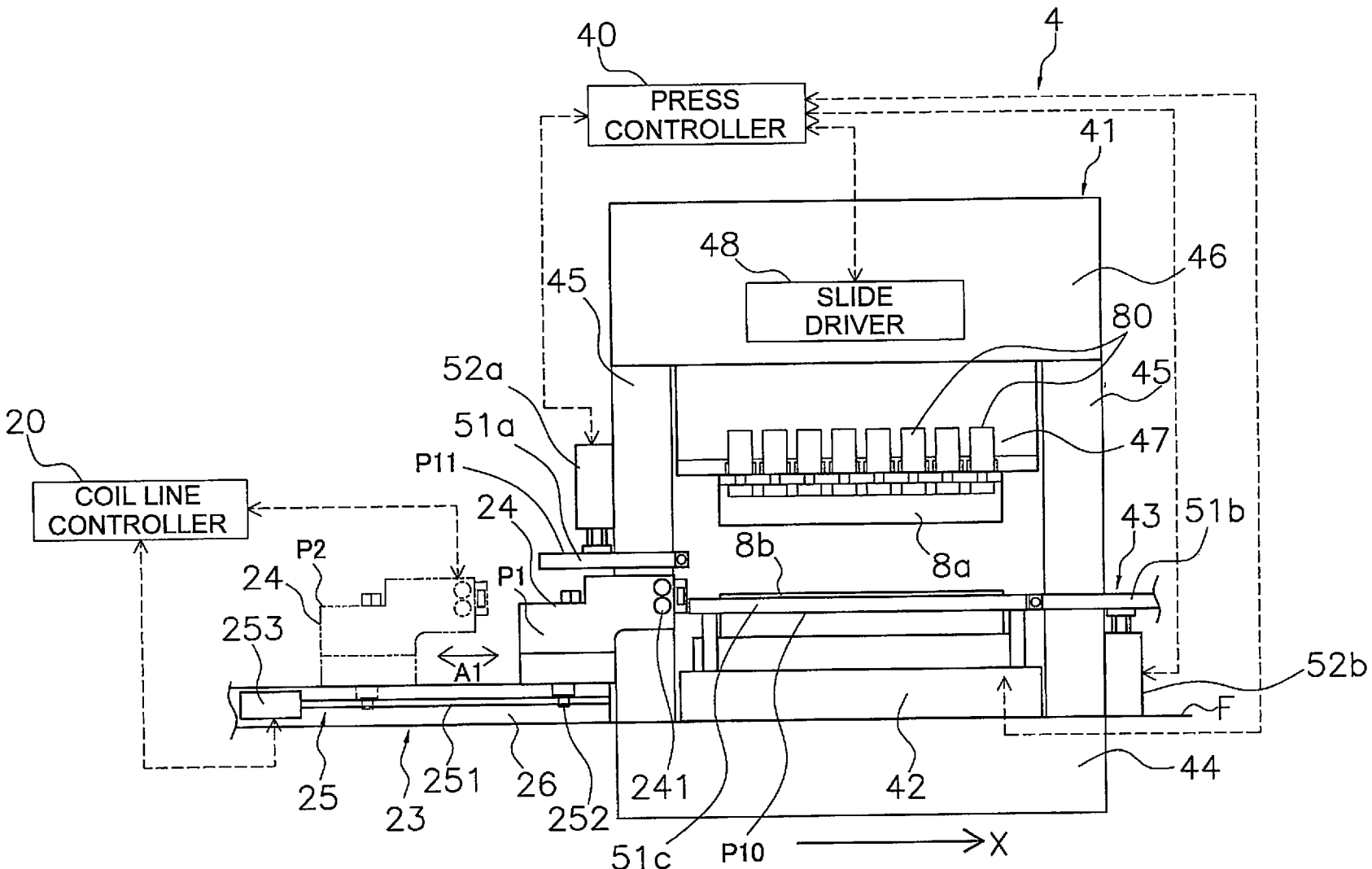
FIG. 3 is a side view of the pressing device and feeder unit in FIG. 1.

The feeder unit 23 is disposed on the downstream side of the leveler 22, with reference to the conveyance direction X of the coiled material 100. FIG. 3 is a side view showing the pressing device 4 and the feeder unit 23. The feeder unit 23 includes a feeder 24, a feeder movement mechanism 25, and a base 26. The feeder 24 has at least one pair of rollers 241, and conveys the coiled material 100 played out from the uncoiler 21 and corrected by the leveler 22 to the pressing device. A concave loop pit 27 is formed in the floor F between the leveler 22 and the feeder unit 23, in which the coiled material 100 forms a loop. This loop eliminates the influence of the intermittent feed of the feeder unit 23 and allows the leveler 22 to be continuously operated. The feeder 24 is placed on the base 26.

The feeder movement mechanism 25 is provided to the base 26, and moves the feeder 24 along the conveyance direction X (see the arrow A1 in FIG. 3). The feeder movement mechanism 25 is disposed below the feeder 24, and has, for example, a ball screw 251, a nut 252, a motor 253, and the like.

The nut 252 is threaded onto the ball screw 251 and fixed to the feeder 24. The ball screw 251 is rotatably disposed on the base 26 in the conveyance direction X. The motor 253 is linked to the ball screw 251, and the ball screw 251 is rotated by the rotation of the motor 253. Although not depicted, rails are fixed to the base 26 along the conveyance direction X, and a block that is slidably mated with the rails is fixed to the feeder 24.

When the nut 252 is moved by the rotation of the ball screw 251, the feeder 24 moves along the rails, and the feeder 24 moves in the conveyance direction X with respect to the base 26. Consequently, the front end of the feeder 24 enters the pressing device 4 and can be upstream of and near a moving bolster 42. In FIGS. 2 and 3, the feeder 24 disposed at an entry position P1 where it has entered the pressing device 4 upstream of and near the moving bolster 42 is indicated by a solid line, and the feeder 24 disposed at an exit position P2 where it has exited the pressing device 4 is indicated by a two-dot chain line.

The coil line controller 20 controls the drive of the uncoiler 21, the leveler 22, and the feeder 24 (the rollers 241) on the basis of a signal from the system controller 10. The coil line controller 20 also controls the drive of the motor 253 to move the feeder 24.

1-3. Feeder Unit Movement mechanism

As shown in FIG. 2, the feeder unit movement mechanism 5 is configured to be able to move (see the arrow A2) the base 26 and the feeder 24 from the usage position P3 upstream of and near the pressing device 4 to the retracted position P4 away from the pressing device 4 in the width direction Y (also referred to as a clamping direction).

As shown in FIG. 2, for example, the feeder unit movement mechanism 5 has a ball screw 91, a nut 92, a motor 93, and the like. Also, as shown in FIG. 2, for example, rails 94 are provided in the width direction Y. A block 231 that is mated to the rails 94 is attached to the lower face of the base 26 of the feeder unit 23. The ball screw 91 is rotated by the rotation of the motor 93, and the feeder unit 23 moves along the rails 94 between the usage position P3 and the retracted position P4.

Here, the usage position P3 is a position near the upstream side of the pressing device 4, and the coiled material 100 can be supplied from the feeder unit 23 to the pressing device 4 in a state in which the feeder unit 23 is disposed in the usage position P3. The retracted position P4 (indicated by a two-dot chain line) is a position where the feeder unit 23 is retracted in order to dispose the destacker unit 3 on the upstream side of the pressing device 4 in the pressing the sheet material 101 (discussed below).

The feeder unit movement mechanism 5 is controlled by the system controller 10. More specifically, the system controller 10 performs rotation control of the motor 93 and so on.

1-4. Destacker Unit

Figure 4:
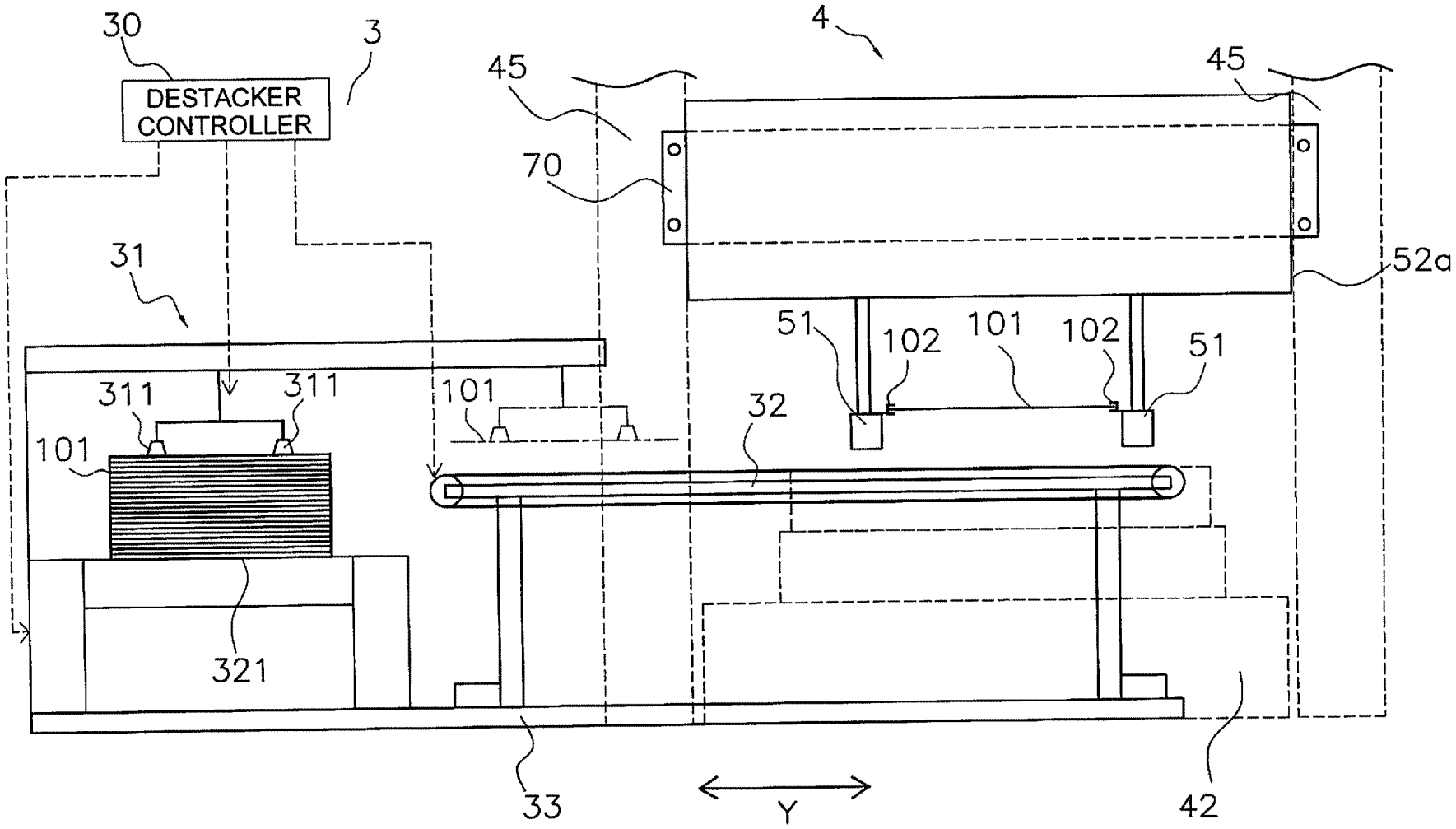
FIG. 4 is a front view of the destacker unit in FIG. 1 as viewed along the conveyance direction.

FIG. 4 is a view of the destacker unit 3 from the upstream side in the conveyance direction X. In FIG. 4, the destacker unit 3 is disposed at the usage position P3 for supplying the sheet material 101 to the pressing device 4. Also, in FIG. 4, in order to make the destacker unit 3 easier to see, uprights 45 and the moving bolster 42 are indicated by dotted lines.

The destacker unit 3 includes a destacker 31, a belt conveyor 32, a base 33, and the destacker controller 30. The destacker 31 and the belt conveyor 32 are disposed on the upper side of the base 33 and are moved together with the base 33 between the usage position P3 and the retracted position P5 by the destacker unit movement mechanism 6 (discussed below).

The destacker 31 separates one piece of the sheet material 101 from the stack in which the sheet material 101 is stacked, and moves it to the belt conveyor 32. The belt conveyor 32 is disposed along the width direction Y, and conveys the sheet member separated by the destacker 31 to a position on the upstream side of the pressing device 4. The sheet material 101 conveyed by the belt conveyor 32 hits a stopper (not shown) and is positioned at a predetermined position. After this, a lifter device (not shown) moves the position of the sheet material 101 in the height direction to match the height of the die 8.

The destacker 31 has suction pads 311 and a placement component 321, and a stack of the sheet materials 101 is disposed on the placement component 321. The suction pads 311 are configured to be able to move between above the placement component 321 and the upper face of the belt conveyor 32, and convey the chucked sheet material 101 from the stack to the upper face of the belt conveyor 32. The placement component 321 is configured such that the vertical position thereof can be moved.

On the basis of a signal from the system controller 10, the destacker controller 30 controls the drive of the suction pads 311, the vertical position of the placement component 321, the rotational drive of the belt conveyor 32, and the lifter device.

1-5. Destacker Unit Movement Mechanism

As shown in FIG. 2, the destacker unit movement mechanism 6 is configured so that the destacker unit 3 can be moved from the usage position P3 upstream of and near the pressing device 4 to the retracted position P5 away from the pressing device 4 in the width direction Y (see the arrow A3). The retracted position P5 is located on the opposite side from the retracted position P4 of the feeder unit 23, with the usage position P3 in between.

As shown in FIG. 2, the destacker unit movement mechanism 6 has, for example, a ball screw 95, a nut 96, a motor 97, and so forth. As shown in FIG. 2, for example, rails 98 are provided along the width direction Y. A block 331 mated to the rails 98 is attached to the lower face of the base 33 of the destacker unit 3. The ball screw 95 is rotated by the rotation of the motor 97, and the destacker unit 3 moves along the rails 98 between the usage position P3 and the retracted position P5.

The sheet material 101 can be supplied from the destacker unit 3 to the pressing device 4 in a state in which the destacker unit 3 is disposed at the usage position P3. The retracted position P5 is a position where the destacker unit 3 has been retracted from the vicinity of the pressing device 4 on the upstream side, and is the position to which the destacker unit 3 is retracted in order to dispose the feeder unit 23 on the upstream side of the pressing device 4 in the pressing of the coiled material 100.

The rails 94 and the rails 98 are connected to each other.

The destacker unit movement mechanism 6 is controlled by the system controller 10. More specifically, the system controller 10 controls the rotation of the motor 97, etc.

1-6. Pressing Device

As shown in FIG. 3, the pressing device 4 is disposed on the downstream side of the coil line 2 and the destacker unit 3, and has a pressing device body 41, the moving bolster 42, a conveyance mechanism 43, the press controller 40, and a bar retraction mechanism 49 (see FIGS. 8A and 9, discussed below).

1-6-1. Pressing Device Body

The pressing device body 41 has a bed 44, the uprights 45, a crown 46, a slide 47, and a slide driver 48.

The bed 44 constitutes the base of the pressing device 4. The uprights 45 are columnar members, and four of them are disposed on the bed 44. As shown in FIG. 2, the four uprights 45 are disposed so as to form the apexes of a rectangle in plan view. The crown 46 is supported upwards by the four uprights 45. The slide 47 is suspended below the crown 46.

The slide driver 48 is provided to the crown 46, and moves the slide 47 up and down. The slide driver 48 comprises, for example, a servomotor (as a drive source), a reduction gear that reduces the rotation of the servomotor, a crank mechanism, and the like. The crank mechanism converts the rotational motion of the servomotor into vertical movement, causing the slide 47 to move up and down.

The upper die 8*a* is attached by movable die clampers 80 to the lower face of the slide 47.

1-6-2. Moving Bolster

The lower die 8*b* is placed on the moving bolster 42. Rails (not shown) are laid on the floor F and the bed 44. The moving bolster 42 has a movement mechanism capable of self-propelling on the rails, and moves between the press position P6 and the die replacement position P7 as shown in FIG. 2 (see the arrow A4). The press position P6 is the position where pressing is performed inside the pressing device body 41. The die replacement position P7 is outside the pressing device body 41 and is the position where replacement of the die 8 is performed. In the replacement of the metal die 8, the moving bolster 42 moves between the uprights 45 in the width direction Y and is disposed at the die replacement position P7.

1-6-3. Conveyance Mechanism

Figure 5:
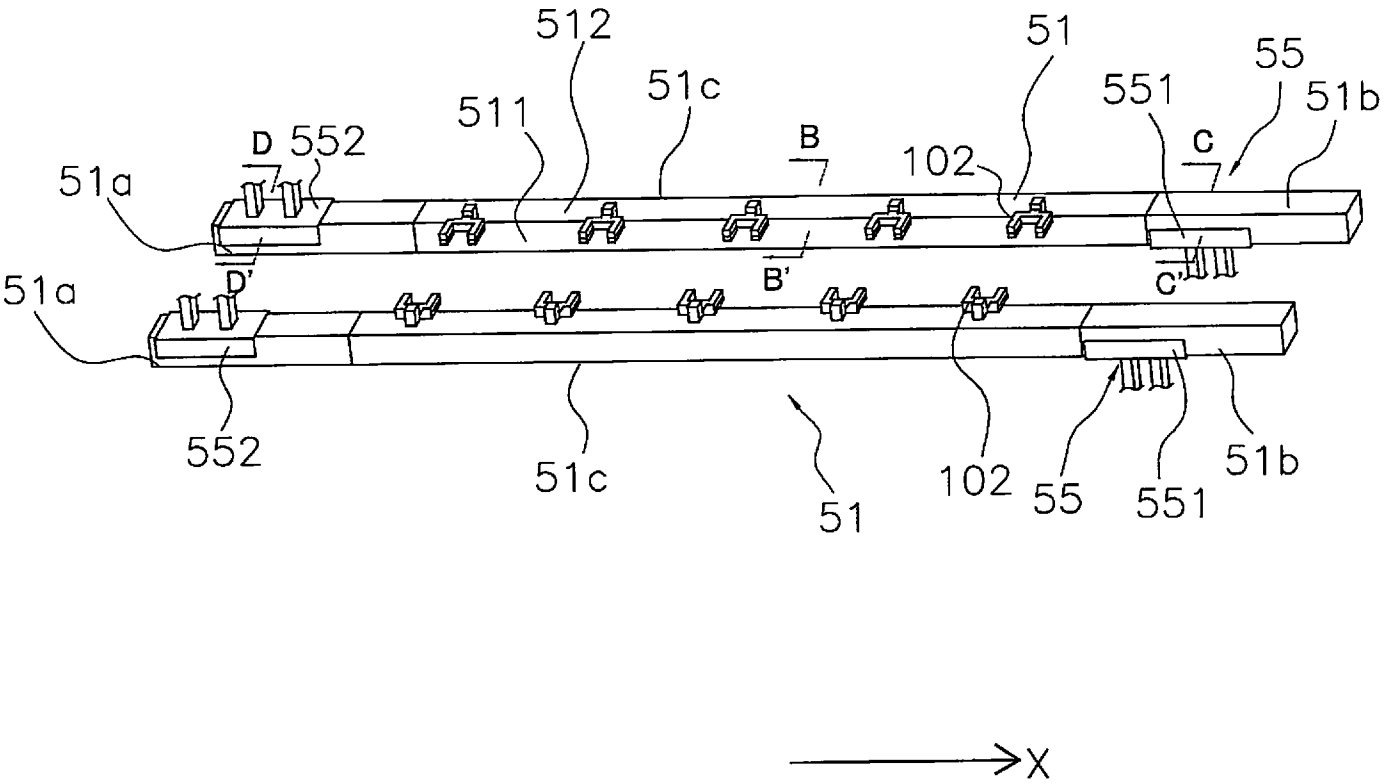
FIG. 5 is an oblique view of a pair of bars of the conveyance mechanism of the pressing device in FIG. 1.
Figure 6C:
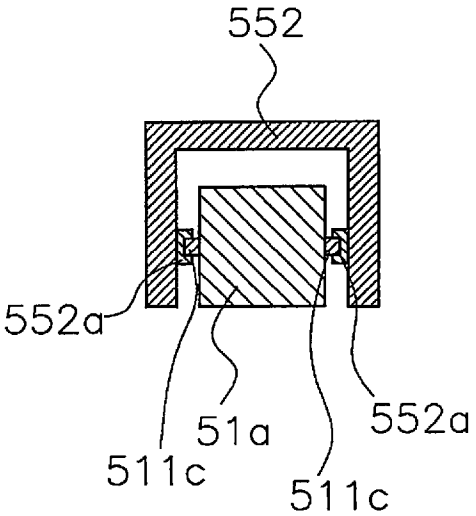
FIG. 6C is a cross section along the D-D' line in FIG. 5.
Figure 6B:
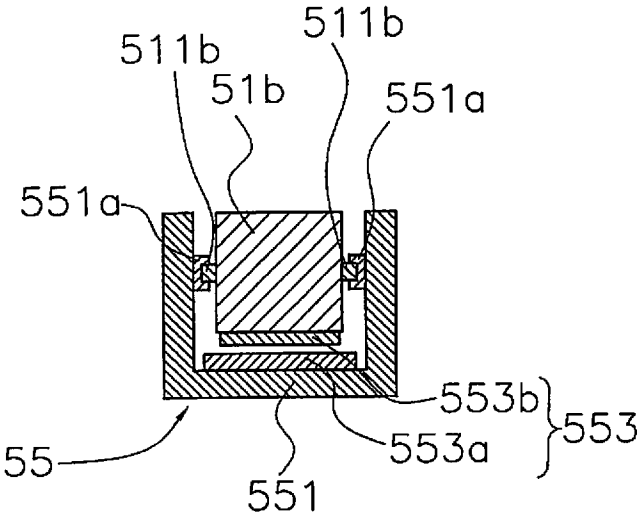
FIG. 6B is a cross section along the CC' line in FIG. 5.
Figure 6A:
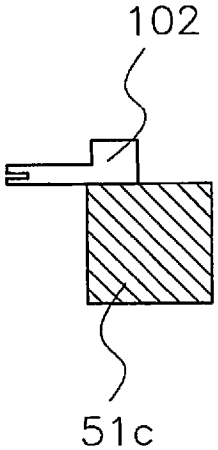
FIG. 6A is a cross section along the B-B' line in FIG. 5.
Figure 7:
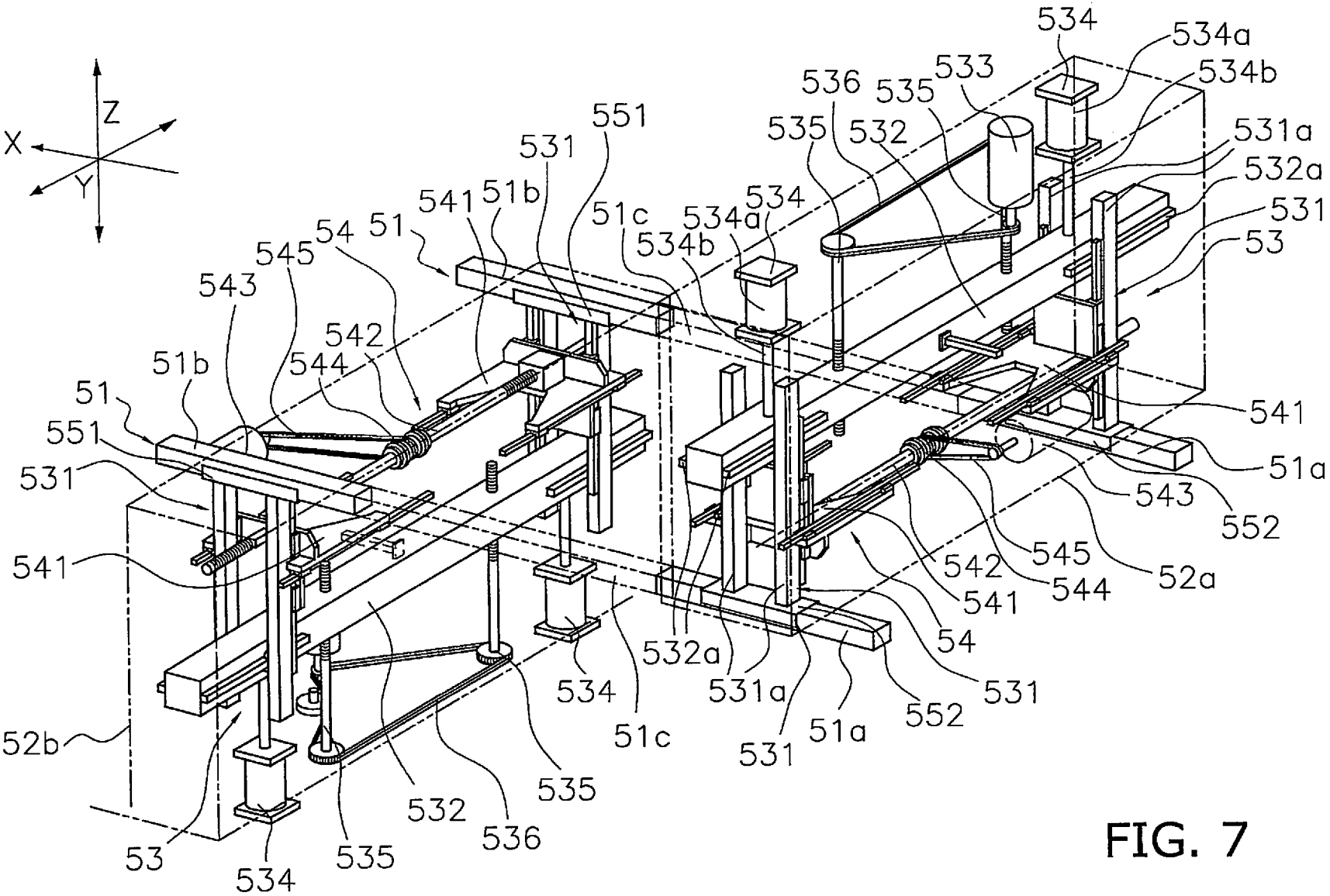
FIG. 7 is an oblique view of the internal structure of the box of the pressing device in FIG. 1.

FIG. 5 is an oblique view of a pair of bars 51 of the conveyance mechanism 43 when the sheet material 101 is being pressed. FIG. 6A is a cross section along the B-B' line in FIG. 5, and FIG. 6B is a cross section along the C-C' line in FIG. 5. FIG. 6C is a cross section along D-D' line in FIG. 5. FIG. 7 is an oblique view of the internal configuration of boxes 52 (52*a* and 52*b*) of the conveyance mechanism 43.

The conveyance mechanism 43 is a transfer feeder and has the pair of bars 51, the boxes 52 (52*a* and 52*b*), lift drive mechanisms 53, clamp drive mechanisms 54, and feed drive mechanisms 55.

a. Bars and Feed Drive Mechanism

In the pressing of the sheet material 101, the bars 51 are disposed parallel to each other along the conveyance direction (feed direction) X inside the uprights 45 and above the moving bolster 42.

Each of the bars 51 is substantially a four-sided columnar member, and as shown in FIG. 3, is constituted so that it can be divided into three parts, and has a first end section 51*a* on the upstream side in the conveyance direction X, a second end section 51*b* on the downstream side in the conveyance direction X, and a center section 51*c* (an example of a holding section). The first end section 51*a* is supported by the lift drive mechanism 53 (described in detail below) disposed in the box 52*a*, and the second end section 51*b* is supported by the lift drive mechanism 53 disposed in the box 52*b*. The center section 51*c* is detachable from the first end section 51*a* and the second end section 51*b*. The first end section 51*a* is disposed between the uprights 45 on the upstream side, and the second end section 51*b* is disposed between the uprights 45 on the downstream side.

The center sections 51*c* of the bars 51 are provided in order to convey the sheet material 101, and fingers 102 for holding a workpiece (formed by either the sheet material 101 or the sheet material 101) are detachably attached to the upper faces of the center sections 51*c*.

A feed drive mechanism 55 is provided at the second end section 51*b* of each bar 51. As shown in FIG. 6B, the feed drive mechanism 55 has a support plate 551 and a linear motor 553.

The support plate 551 is a U-shaped member and is provided so as to cover the lower side of the second end section 51*b*. The support plate 551 is fixed to the upper end of two lift bars 531*a* (discussed below) of the lift drive mechanism 53 disposed in the box 52*b*. The support plate 551 has guide holders 551*a* on the inner sides of its side walls. Guide rails 511*b* are provided on the side faces of the second end section 51*b* along the conveyance direction X. The second end section 51*b* is configured to be movable in the conveyance direction X with respect to the support plate 551 when the guide holders 551*a* are fitted to the guide rails 511*b*.

The linear motor 553 mainly has a coil 553*a* disposed on the inner bottom face of the support plate 551, and a magnet plate 553*b* disposed on the lower face of the second end section 51*b*. The coil 553*a* and the magnet plate 553*b* are disposed opposite each other. When a current is passed through the coil 553*a*, a force that attracts or repels is generated between the coil 553*a* and the magnet plate 553*b*, and the second end section 51*b* moves in the feed direction with respect to the support plate 551.

The feed drive mechanism 55 is provided to the second end section 51*b*, and the second end section 51*b* is connected to the center section 51*c*. As a result, along with the movement of the second end section 51*b* in the conveyance direction X direction, the center section 51*c* also moves, and the sheet material 101 held by the fingers 102 attached to the center section 51*c* can move in the conveyance direction X.

As shown in FIG. 6C, a support plate 552 is provided to the first end section 51*a*. The support plate 552 is an inverted U-shaped member, and is provided so as to cover the upper side of the first end section 51*a*. The support plate 552 is fixed to the lower end of two lift bars 531*a* (discussed below) of the lift drive mechanism 53 disposed inside the box 52*a*. The support plate 552 has a guide holder 552*a* on the inner side of both of its side walls. Guide rails 511*c* are provided on the side faces of the first end section 51*a* along the conveyance direction X. The first end section 51*a* is configured to be able to move in the conveyance direction X with respect to the support plate 551 by matting the guide holders 552*a* with the guide rails 511*c*.

As described above, the bars 51 each have the first end section 51*a*, the center section 51*c*, and the second end section 51*b*, and the slide plate 512 is moved in the feed direction by the feed drive mechanism 55 provided to the second end section 51*b*.

b. Box

As shown in FIG. 3, the box 52*a* is disposed on the upstream side in the conveyance direction X of the moving bolster 42 when disposed in the press position P6. The box 52*b* is disposed on the downstream side in the conveyance direction X of the moving bolster 42 when disposed in the press position. The box 52*a* is fixed to a frame member 70 (see FIG. 4) that is fixed to the upper side of the first end section 51*a*, across the two uprights 45 on the upstream side. The box 52*b* is disposed on the bed 44 on the lower side of the second end section 51*b*.

FIG. 7 is an oblique view of the internal structure of the box 52*a* and the box 52*b*. Since the configuration of the box 52*b* is the same as that of the box 52*a* except that it is turned upside down, the internal structure of the box 52*a* will be described, and the description of the internal structure of the box 52*b* will be omitted.

The lift drive mechanism 53 and the clamp drive mechanism 54 are provided in the boxes 52*a* and 52*b*, respectively.

c. Lift Drive Mechanism

The lift drive mechanism 53 includes lift carriers 531 that are fixed to two bar main bodies 511, a lift beam 532 that supports the lift carriers 531, a lift motor 533 that moves the lift beam up and down, air cylinders 534 that serve as balancers.

The lift carriers 531 each have two lift bars 531*a* that are fixed to the bar main bodies 511 with a specific spacing in between them. Two pairs of the lift bars 531*a* are disposed in the width direction Y. Each pair of lift bars 531*a* is fixed to the upper face of the support plate 552 that supports the first end section 51*a* slidably in the conveyance direction X.

The lift beam 532 is a rod-shaped member disposed along the width direction Y, and is disposed between the pair of lift bars 531*a*. Rail members 532*a* are provided on both side faces in the conveyance direction X at the left and right ends of the lift beam 532 along the width direction Y. Rollers (not shown) are provided to the lift bars 531*a* so as to sandwich the rail members 532*a* from above and below. This allows the lift carriers 531 to move in the width direction Y while being supported by the lift beam 532 along the rail members 532*a*.

The lift beam 532 is supported from below by two screws 535 rotatably attached on the upper face of the box 52*a*. The screws 535 are rotated by the lift motor 533 via a belt 536. When the screws 535 are rotated, the lift beam 532 moves in the up and down direction Z, so that the first end section 51*a* fixed to the lift carriers 531 also moves in the up and down direction Z.

The two air cylinders 534 are provided in the width direction Y. The air cylinders 534 each have a cylinder portion 534*a* and a rod 534*b*. The cylinder portion 534*a* is fixed to the upper face of the box 52*a*, and the lower end of the rod 534*b* is fixed to the lift beam 532. These air cylinders 534 are provided in order to balance the weight of the bars 51, the lift beam 532, the lift carriers 531, and so on.

d. Clamp Drive Mechanism

The clamp drive mechanism 54 mainly has a pair of clamp carriers 541, a ball screw 542, a clamp motor 543, and so on.

The clamp carriers 541 are fixed to the two lift carriers 531 disposed in the width direction Y.

The ball screw 542 is disposed along the width direction Y, and is mated to the clamp carriers 541 at both ends in the width direction Y. The ball screw 542 is configured such that threads are formed in opposite directions at the portions mated to the two clamp carriers 541, and when the ball screw 542 is rotated in one direction, the two clamp carriers 541 move toward the inside in the width direction Y, while rotation in the other direction causes the two clamp carriers 541 to move toward the outside in the width direction Y.

A pulley 544 is fixed to the ball screw 542, and the pulley 544 and the clamp motor 543 are connected via a belt 545. That is, when the clamp motor 543 is driven, the pulley 544 and the ball screw 542 rotate, and the clamp carriers 541 move to the inner or outer side in the width direction Y. Since the clamp carriers 541 are connected to the bars 51 via the lift carriers 531, movement of the two clamp carriers 541 to the inside or outside in the clamping direction Y also moves the bars 51 to the inside or outside in the clamping direction Y.

The internal configuration of the box 52*b* is a vertically inverted mirror image of the internal configuration of the box 52*a*.

1-6-4. Bar Retraction Mechanism

Figure 8B:
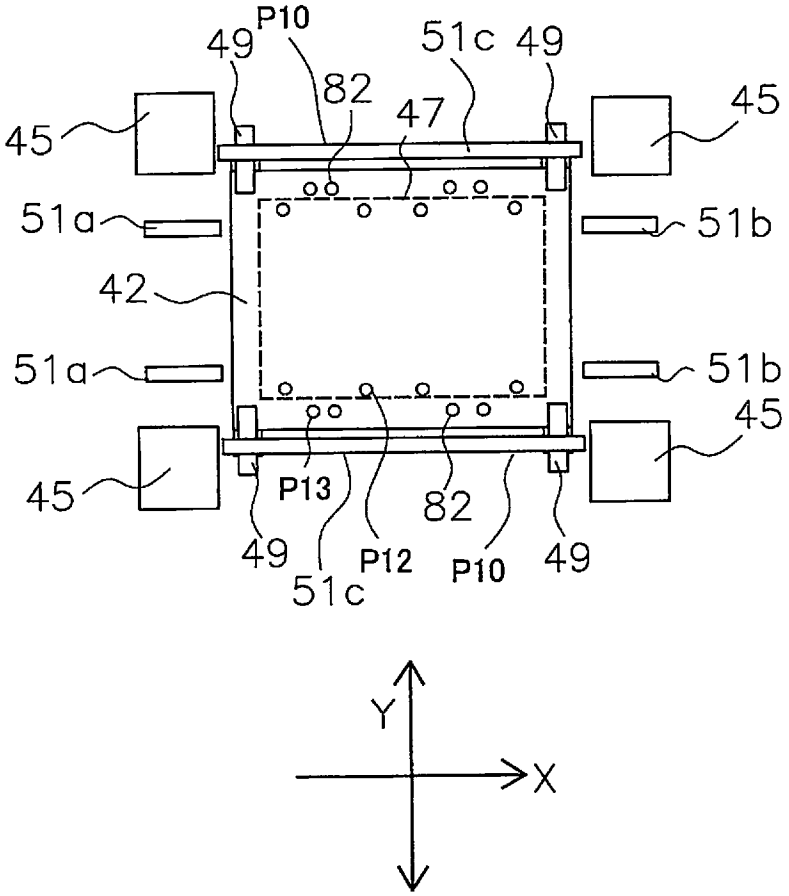
FIG. 8B is a simplified plan view of the state of the bars when a coiled material is pressed in the pressing device of FIG. 1.
Figure 8A:
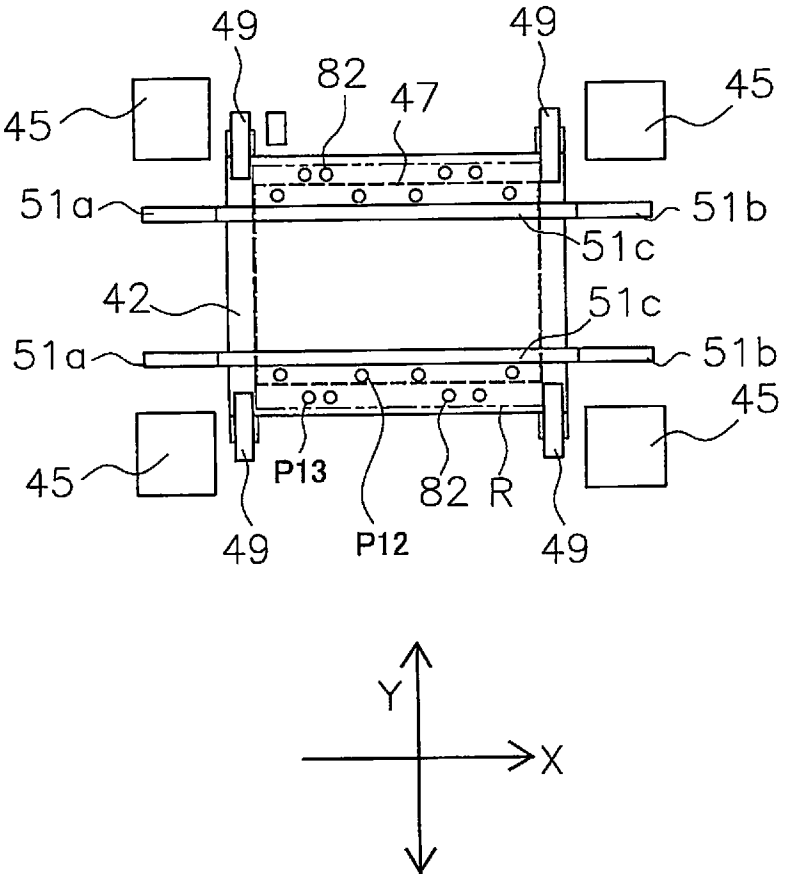
FIG. 8A is a simplified plan view of the state of the bars when a sheet material is pressed in the pressing device of FIG. 1.

FIG. 8A is a simplified plan view of the state of the bars 51 when pressing the sheet material 101. FIG. 8B is a simplified plan view of the state of the bars 51 when pressing the coiled material 100. In FIGS. 8A and 8B, the slide 47 is indicated by a dotted line.

The bar retraction mechanism 49 (an example of a second retraction mechanism) is provided to the moving bolster 42. As shown in the drawing, in the pressing of the coiled material 100, the center sections 51*c* of the pair of bars 51 are moved outward in the width direction Y beyond the working region in which pressing is performed. Here, the "working region" is the region in which the slide 47 and the die clampers 80 and other such components that move together with the slide 47 move during working, and "the outside of working region" is a position at which there is no interference with the slide 47 and the die clampers 80 and other such components that move together with the slide 47 in the width direction Y.

Figure 8D:
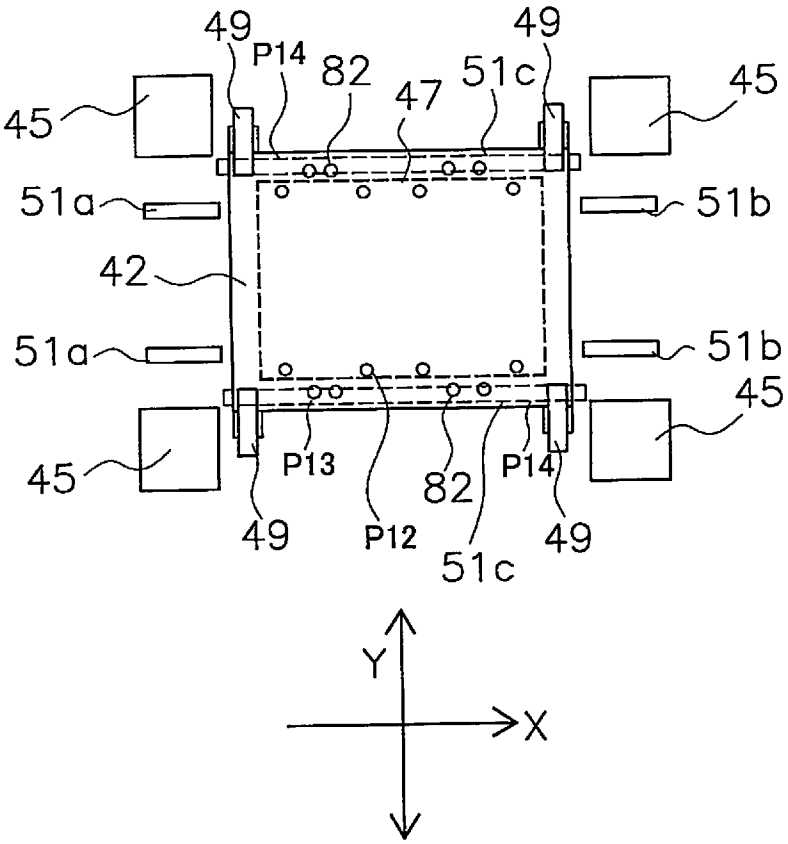
FIG. 8D is a simplified plan view of the state when the center sections of the bars are placed on a support member in the pressing device of FIG. 1.
Figure 8C:
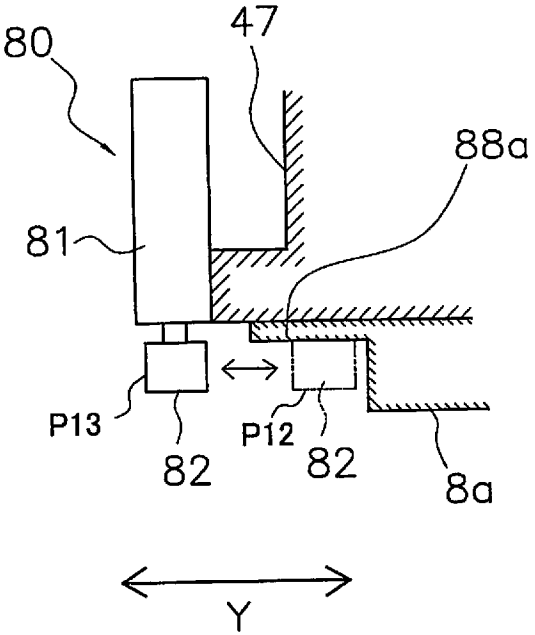
FIG. 8C is a diagram illustrating a die clamper in the pressing device of FIG. 1.

The working region and, the arrangement of the slide 47 and the die clampers 80 will now be described. As shown in FIG. 3, a plurality of die clampers 80 are provided along the conveyance direction X at the end of the slide 47. FIG. 8C is a view of near the end of the slide 47 as viewed along the conveyance direction X. The die clampers 80 are provided on the outside in the width direction Y of the lower end of the slide 47. The die clampers 80 each have a box 81 and a clamper head 82. The box 81 is fixed to the slide 47. A drive means (sprocket and chain, etc.) for moving the clamper head 82 in the width direction Y is disposed in the box 81. The clamper head 82 is provided so as to protrude from the lower side of the box 81, and is able to move inward in the width direction Y (see the arrow in FIG. 8C). A flange 88*a* is formed at the end of the upper die 8*a* in the width direction Y, and the clamper heads 82 move to the lower side of the flange 88*a*.

When hydraulic pressure is supplied to the clamper heads 82 in a state of being disposed under the flange 88*a*, the upper die 8*a* is pressed against the slide 47 by the clamper heads 82, and the upper die 8*a* is fixed to the slide 47.

In this way, the clamper heads 82 move between the support position P12 inside the slide 47 and the retracted position P13 on the outside of the slide 47.

Since the die 8 (the upper die 8*a* and the lower die 8*b*) comes in various shapes, as shown in FIGS. 8A and 8B, some of the clamper heads 82 will be disposed at the retracted position P13 (indicated by a two-dot chain line), without moving to the support position P12. In FIGS. 8A and 8B, the positions of the clamper heads 82 are indicated by circles.

Accordingly, the working region is the region including the die clampers 80, and is the region R indicated by the two-dot chain line in FIG. 8A, for example.

Figure 9:
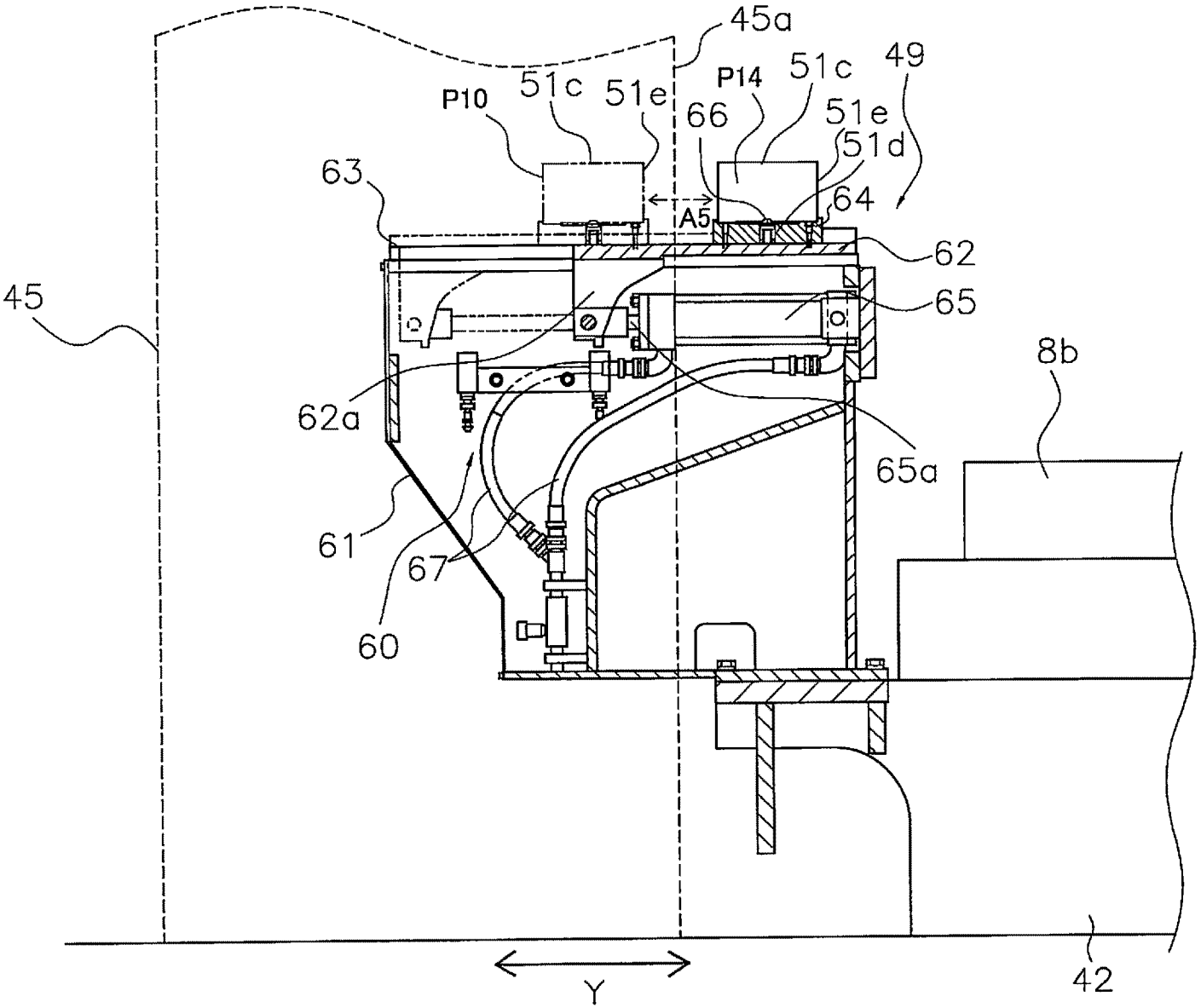
FIG. 9 is a cross section of a bar retracting mechanism of the pressing device in FIG. 1, as viewed along the conveyance direction.

FIG. 9 is a diagram of a bar retraction mechanism 49 as viewed along the conveyance direction X. As shown in FIG. 9, each bar retraction mechanism 49 has a bar support member 64 (an example of a support member) and a support member movement mechanism 60 (an example of a support member movement mechanism). The center section 51*c* of the bar 51 is placed on the bar support member 64. The support member movement mechanism 60 moves the bar support member 64 in the width direction Y.

The support member movement mechanism 60 has a fixed box 61, a slide substrate 62, guide rails 63, the bar support member 64 (an example of a support member), a slide cylinder 65, and so on.

The fixed box 61 is attached to the side face of the moving bolster 42 in the width direction Y. The slide substrate 62 is provided movably in the width direction Y on the upper face of the fixed box 61. The guide rail 63 is provided in the width direction Y on the upper face of the fixed box 61 and mate with the slide substrate 62. This allows the slide substrate 62 to move along the guide rail 63. The bar support member 64 is fixed on the slide substrate 62. The upper face of the bar support member 64 is formed in a concave shape, and a center section 51*c* of the bar 51 is disposed thereon. A pin 66 that is biased upward by a spring member is provided in the center of the concave portion of the bar support member 64 so as to freely protrude and retract. This pin 66 is inserted into a pin hole 51*d* formed in the bottom face of the center section 51*c* of the bar 51 to position the center section 51*c* of the bar 51 and prevent lateral offset.

The slide cylinder 65 is disposed in the fixed box 61, and its proximal end is fixed to the fixed box 61. A rod 65*a* of the slide cylinder 65 is connected to a bracket 62*a* formed on the lower side of the slide substrate 62. Some of the air supplied to the moving bolster 42 can be supplied to the slide cylinder 65 via a pipe 67.

In the pressing of the coiled material 100, the center section 51*c* is placed on the bar support member 64 disposed at the position indicated by the solid line in FIG. 9 (the position of the center section 51*c* at this point is shown as the placement position P14). Also, the center section 51*c* in this state is shown by a dotted line in FIG. 8D. If an attempt were made to perform pressing in this state, the center section 51*c* of the bar 51 would interfere with the clamper heads 82 and the boxes 81 disposed at the retracted position P13. As shown in FIG. 8D, since the bar retraction mechanism 49 is disposed on the downstream side and the upstream side of the slide 47 in the transport direction X, the bar retraction mechanism 49 does not interfere with the die clampers 80.

After the center section 51*c* has been disposed in the placement position P14, the bar support member 64 is moved outward in the width direction by extending the slide cylinder 65. As shown by the imaginary lines in FIG. 9, this allows the center section 51*c* to be disposed at the retracted position P10 that is further outside than the inner faces 45*a* of the uprights 45 in the width direction Y (see the arrow A5). More precisely, the inner end face 51*e* of the center section 51*c* is positioned more to the outside than the inner faces 45*a* of the uprights 45 in the width direction Y, which is perpendicular to the conveyance direction X. This movement produces the state in FIG. 8B. Consequently, the center section 51*c* is located more to the outside than the working region. As long as there is no interference with the working region, a part of the center section 51*c* may protrude more to the inside than the inner faces 45*a* of the uprights 45.

1-6-5. Retraction Mechanism of First End 51*a* of Bar 51

In the pressing of the coiled material 100 as described above, the bars 51 are split into the first end section 51*a*, the center section 51*c*, and the second end section 51*b*, and the center section 51*c* is retracted by the bar retraction mechanism 49. Meanwhile, on the upstream side of the pressing device 4, the front end of the feeder 24 goes inside in order to feed the front end of the coiled material 100 into the pressing device 4. Therefore, the first end section 51*a* is moved upward by the lift drive mechanism 53 in order to ensure room for the front end of the feeder 24 to come in. Thus, the lift drive mechanism 53 also serves as a mechanism for retracting the first end section 51*a*, and corresponds to an example of a first retraction mechanism.

The second end section 51*b* is disposed at the outermost position in the width direction Y, for example, so as not to interfere with the conveyance of the coiled material 100.

As described above, in the pressing of the sheet material 101, the first end sections 51*a* of the bars 51 used for conveying the sheet material 101 are moved to the upper retracted position P11, and the center sections 51*c* of the bars 51 are moved to the retracted position P10 outside the working region, which makes it possible to perform pressing of the coiled material 100 in the pressing device 4, which is a transfer press.

In most cases, the retracted position P11 is located above the uppermost position of the bars 51 in operation during conveyance of the sheet material 101, but it is not limited to this, and the location will depend on the shape of the die before and after replacement.

1-6-6. Press Controller

The press controller 40 controls the slide driver 48 that moves the slide 47 up and down, the conveyance mechanism 43 that conveys the sheet material 101 within the pressing device 4, and the bar retraction mechanism 49 that retracts the center section 51*c* to the outside of the pressing region.

2. Operation

Figure 10:
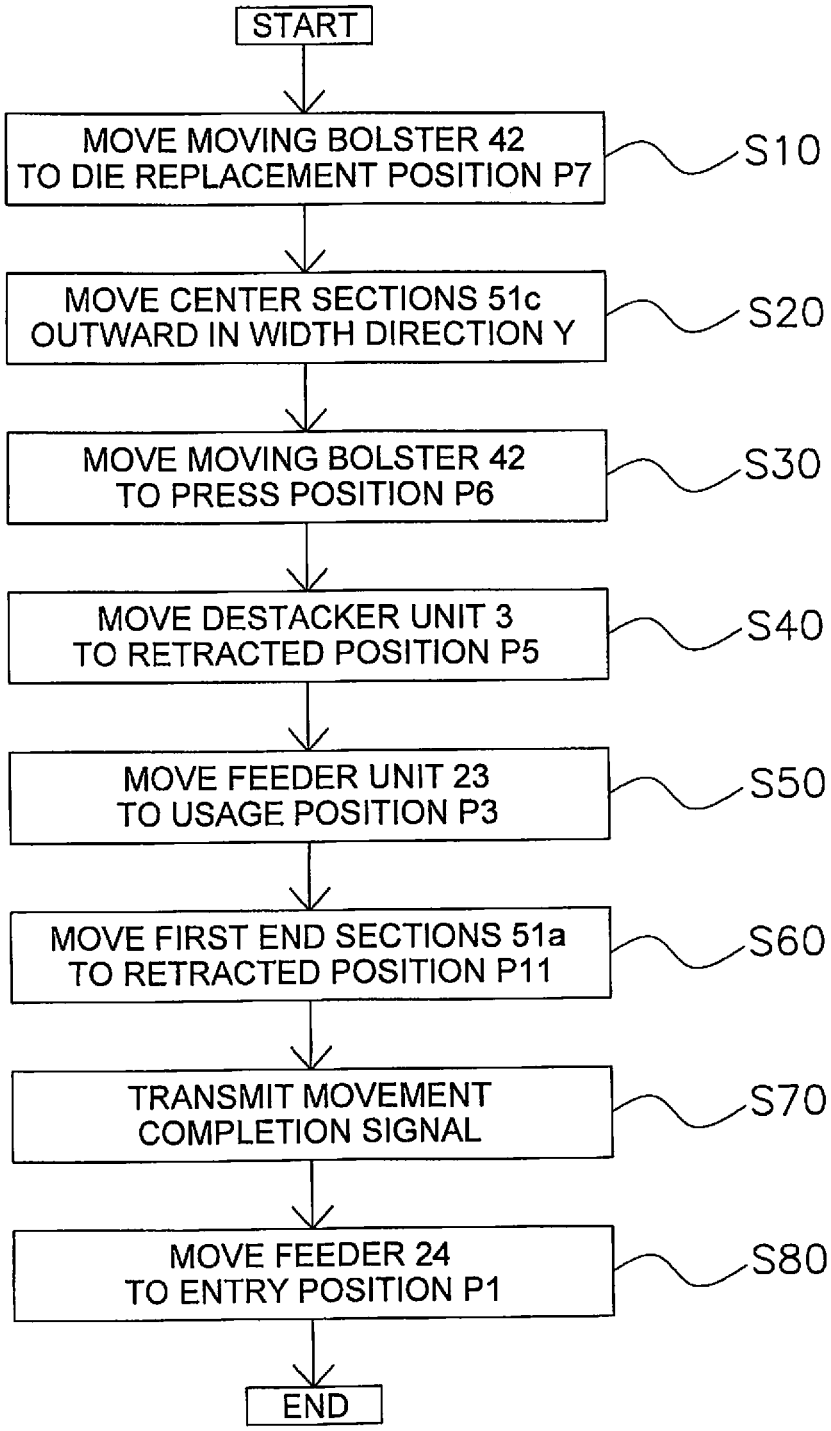
FIG. 10 is a flowchart of the operation of the press system in FIGS. 1 to 3.

Next, the operation of the press system 1 in this embodiment will be described, and an example of a method for controlling the pressing device of the present invention will also be described. FIG. 10 is a flowchart of the operation of the press system 1 in this embodiment. FIGS. 11A to 11D are simplified diagrams of the state of the press system 1 for explaining this operation.

The operation up until the pressing of the coiled material 100 is performed after completion of the pressing of the sheet material 101 will be described below.

In the pressing of the sheet material 101, as shown in FIG. 1 IA, the destacker unit 3 is disposed at the usage position P3, and the feeder unit 23 is disposed at the retracted position P4 shown in FIG. 2.

First, in step S10, the center sections 51*c* of the bars 51 are placed on the bar support member 64, and the moving bolster 42 is moved from the press position P6 to the die replacement position P7.

Next, in step S20, having received the signal from the system controller 10, the press controller 40 controls the bar retraction mechanism 49 to move the center sections 51*c* outward in the width direction Y. At the die replacement position P7, for example, the die is replaced with a die to be used for pressing the coil material 100, but the center sections 51*c* and the die can be prevented from coming into contact in the course of the die replacement work by retracting the center sections 51*c* outward. Furthermore, the movement of the center sections 51*c* to the outside may be performed at the press position P6 before moving the moving bolster 42 to the die replacement position P7.

Next, in step S30, upon receiving an instruction from the system controller 10, the press controller 40 moves the moving bolster 42 with the replaced die from the die replacement position P7 to the press position P6. Here, since the center sections 51*c* are being moved to the outside, in a state of being disposed at the press position P6, as shown in FIG. 8B, the center sections 51*c* are located more to the outside in the width direction Y than the inner faces 45*a* of the uprights 45, and are disposed at the retracted position P10. If two moving bolsters 42 are provided, the die replacement operation is performed while pressing is being performed by one moving bolster 42. Steps S10, S20, and S30 correspond to an example of the second retraction step of the present invention.

Next, in step S40, the system controller 10 transmits a signal to the destacker unit movement mechanism 6 to control the motor 97 on the basis of a user operation or the like, and the destacker unit 3 is moved from the usage position P3 to the retracted position P5. Step S40 may be performed simultaneously with step S10.

Figure 11C:
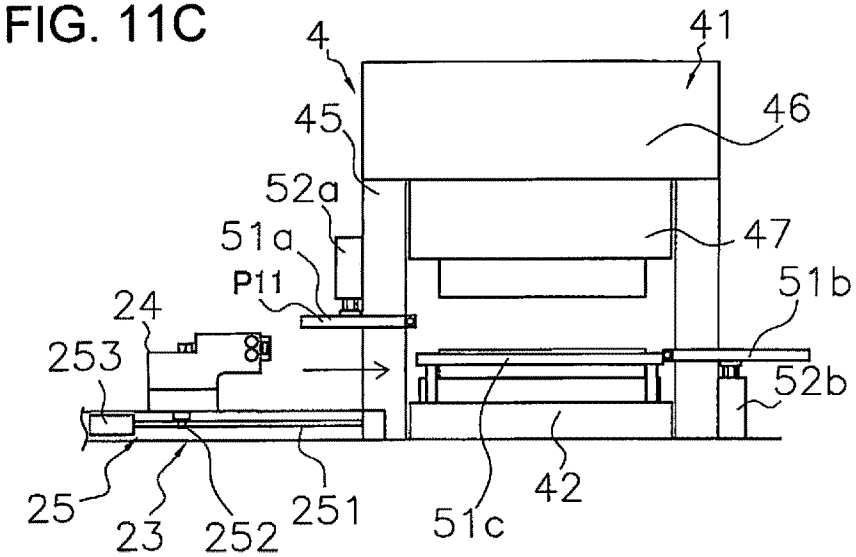
FIGS. 11A to 11D are simplified side views illustrating the operation of the press system in FIG. 1.
Figure 11A:
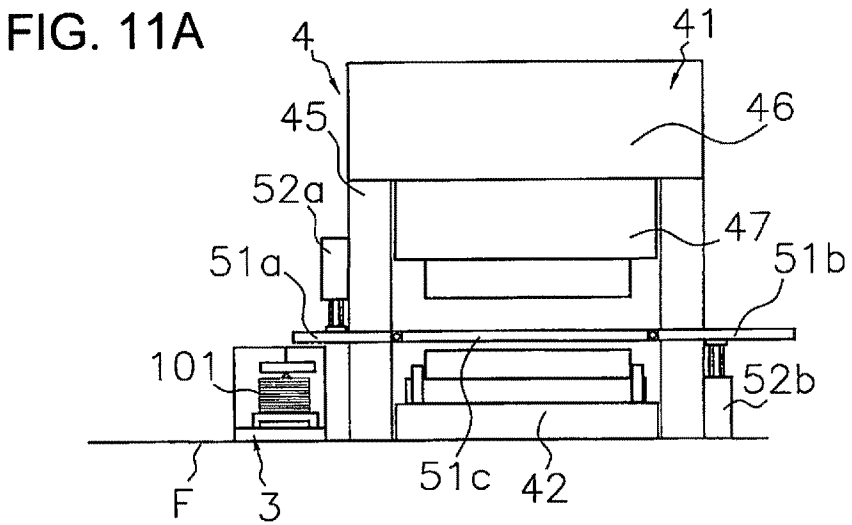

Next, in step S50, the system controller 10 transmits a signal to the feeder unit movement mechanism 5 to control the motor 93, and the feeder unit 23 is moved from the retracted position P4 to the usage position P3. This state is shown in FIG. 11B.

Next, in step S60, having received the signal from the system controller 10, the press controller 40 controls the lift drive mechanism 53 disposed in the box 52*a* to pull the first end sections 51*a* upward. As a result, the first end sections 51*a* are disposed in the retracted position P11. Step S60 may be performed when the center sections 51*c* are disposed on the bar support member 64 in step S10. This state is shown in FIG. 11C. Step S60 corresponds to an example of the first retraction step of the present invention.

Next, in step S70, the press controller 40 transmits a signal indicating that the movement of the first end sections 51*a* to the retracted position P11 is complete to the coil line controller 20 via the system controller 10. Step S70 corresponds to an example of the transmission step of the present invention.

Next, in step S80, having received the signal from the system controller 10, the coil line controller 20 drives the motor 253 to move the feeder 24 in the conveyance direction X with respect to the base 26. As a result, the front end of the feeder 24 enters the pressing device 4 and is positioned upstream of and near the moving bolster 42. This state is shown in FIG. 11D.

The above operation produces a state in which the front end of the coiled material 100 can be fed into the pressing device 4, and then the coiled material 100 is supplied from the coil line 2 to the pressing device 4, and the coiled material 100 is pressed.

Figure 11D:
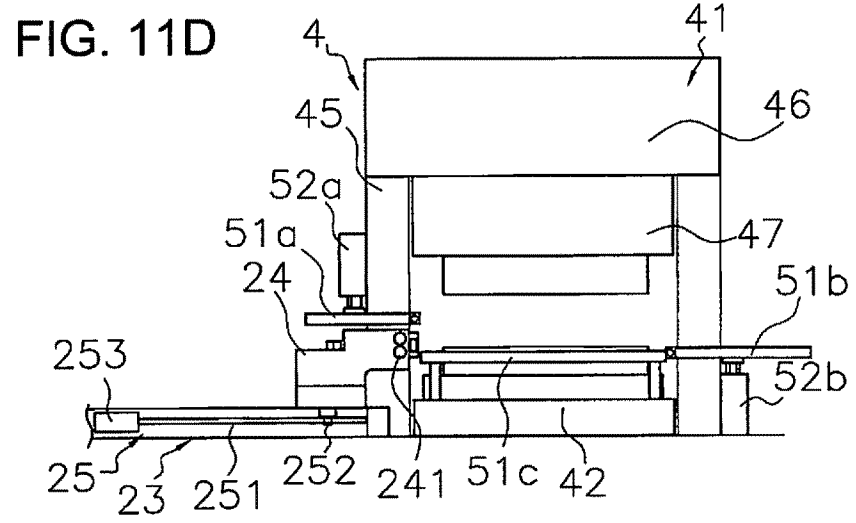
Figure 11B:
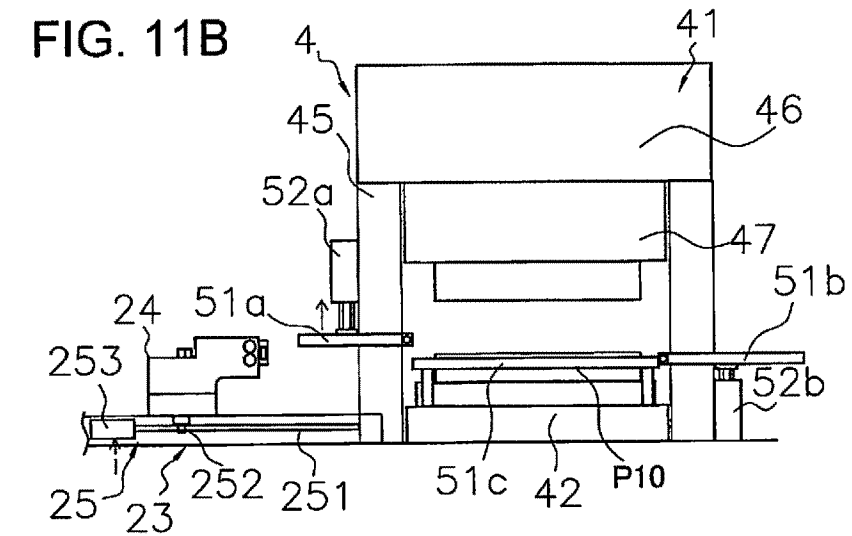

In feeding the rear end of the coiled material 100 into the pressing device 4, the feeder 24 goes into the pressing device 4 and moves to a position upstream of and near the moving bolster 42 (the same state as in FIG. 11D).

When pressing of the sheet material 101 is performed after pressing of the coiled material 100, the procedure is the reverse of the above.

As described above, the first end sections 51*a* of the bars 51 used for conveying the sheet material 101 while pressing the sheet material 101 are moved to the upper retracted position P11, and the center sections 51*c* of the bars 51 are moved to the retracted position P10 outside the working region, which makes possible the terminal treatment of the coiled material 100 in the pressing device 4, which is a transfer press.

Also, since the first end sections 51*a* provided on the upstream side of the pressing device 4 are moved upward, a space which the feeder 24 can enter can be ensured with a compact configuration, without increasing the width.

3. Features, Etc.

(3-1)

The pressing device 4 in this embodiment is a pressing device 4 capable of selectively pressing either the coiled material 100 or the sheet material 101, and comprises the pair of bars 51 and the lift drive mechanism 53 (an example of a first retraction mechanism). The bars 51 each have the center section 51*c* (an example of a holding section), the first end section 51*a*, and the second end section 51*b*. The center section 51*c* (an example of a holding section) can hold the sheet material 101. The first end section 51*a* is detachable from the center section 51*c* and is on the upstream side of the center section 51*c* in the material conveyance direction X. The second end section 51*b* is detachable from the center section 51*c* and is on the downstream side of the center section 51*c* in the conveyance direction X. The lift drive mechanism 53 moves the first end sections 51*a* to the upper retracted position P11 (an example of a first retracted position) when the pressing of the coiled material 100 is being performed.

With the above configuration, the first end sections 51*a* on the upstream side of the bars 51 can be retracted upward by the lift drive mechanism 53. Therefore, a space into which the feeder 24 can enter is formed under the first end sections 51*a*, the front end of the feeder 24 can be positioned upstream of and near the moving bolster 42, and terminal processing of the coiled material 100 is possible.

As described above, interference between the bars 51 and the feeder 24 can be avoided by retracting the first end sections 51*a*, so when the coiled material 100 is pressed, the feeder 24 will be able to enter the pressing device 4. Also, since the first end sections 51*a* are retracted upward, it is not necessary to make the pressing device 4 any wider than the required width (the width determined from the width of the material to be pressed, etc.). Therefore, the coiled material 100 and the sheet material 101 can be pressed with a compact configuration.

(3-2)

The pressing device 4 in this embodiment further comprises the bar retraction mechanism 49 (an example of a second retraction mechanism). When the coiled material 100 is being pressed, the bar retraction mechanism 49 retracts the center sections 51*c* of the bars 51 to the retracted position P10 (an example of a second retracted position) that is outside the region where the pressing is performed.

Here, a method in which the first end sections 51*a*, the center sections 51*c*, and the second end sections 51*b* are collectively moved to the retracted position P10 while still linked together is also conceivable, in which case the position of the center sections 51*c* is higher than the normal pressing position, and there may be interference with the slide 47.

However, the center sections 51*c* of the bars 51 can be retracted from the region where the pressing is performed, and the coiled material 100 can be pressed.

(3-3)

The pressing device 4 in this embodiment further comprises the moving bolster 42. The bar retraction mechanism 49 (an example of a second evacuation mechanism) is provided to the moving bolster 42, and movement is possible in the space between the press position P6 at which pressing is performed and the die replacement position P7 at which replacement of the die 8 is performed. The bar retraction mechanism 49 has the bar support member 64 (an example of a support member) and the support member movement mechanism 60. The bar support member 64 supports the center sections 51*c* of the bars 51. The support member movement mechanism 60 moves the bar support member 64 to the outside of the region where pressing is performed.

Here, in the replacement of a die, the fingers 102 holding the sheet material 101 are usually also replaced, so the center sections 51*c* of the bars 51 are moved together with the die 8 to the die replacement position P7 by the moving bolster 42, and the bar retraction mechanism 49 can be used as a support member for supporting the center sections 51*c* for this purpose.

(3-4)

The pressing device 4 in this embodiment further comprises the slide 47, the crown 46, and the plurality of uprights 45. The upper die 8*a* can be attached to the lower face of slide 47. The crown 46 is disposed above the slide 47 and supports the slide 47 so that it can move up and down. The uprights 45 support the crown 46 above the slide 47. As shown in FIG. 9, the retracted position P10 (an example of a second retracted position) is located more to the outside than the inner faces 45*a* of the uprights 45 in the width direction perpendicular to the conveyance direction X.

This allows the center sections 51*c* of the bars 51 to be retracted from the region where the pressing is performed, which makes it possible for the coiled material 100 to be pressed.

(3-5)

The pressing device 4 in this embodiment further comprises the lift drive mechanism 53. The lift drive mechanism 53 is disposed on the upper side of the first end sections 51*a*, and moves the first end sections 51*a* of the bars 51 in the up and down direction in the conveyance of the sheet material 101. The lift drive mechanism 53 also serves as a first retraction mechanism, and moves the first end sections 51*a* to the upper retracted position P11 (an example of a first retracted position) in the pressing of the coiled material 100.

Thus, the lift drive mechanism 53 of the bars 51 can be used to retract the first end sections 51*a* of the bars 51 upward.

(3-6)

The method for controlling the pressing device 4 in this embodiment is a method for controlling a pressing device capable of selectively pressing either the coiled material 100 or the sheet material 101, and comprises step S60 (an example of a first retraction step), and step S70 (an example of a transmission step). In step S60 (an example of the a retraction step), in the pressing of the coiled material 100, a first end sections 51*a* of the pair of bars 51, each having a center section 51*c* (an example of a holding section) that holds the sheet material 101, and a first end section 51*a* that can be linked to and separated from the center section 51*c* on the upstream side of the center section 51*c* in the conveyance direction X of the material, and a second end section 51*b* that can be linked to and separated from the center section 51*c* on the downstream side of the center section 51*c* in the conveyance direction X, are moved to the upper retracted position P11 (an example of a first retracted position). Upon completion of step S60 (an example of a first retraction step), in step S70 (an example of a transmission step) a signal is transmitted as a trigger to cause the feeder 24 for supplying the coiled material 100 to the pressing device 4 to enter the pressing device 4.

The above operation allows the first end sections 51*a* on the upstream side of the bars 51 to be retracted upward. Therefore, a space into which the feeder 24 can enter is formed below the first end sections 51*a*, and the feeder 24 can enter upstream of and near the moving bolster 42, enabling the terminal treatment of the coiled material 100.

As described above, retracting the first end sections 51*a* avoids interference between the bars 51 and the feeder 24, so when the coiled material 100 is pressed, the feeder 24 is able to enter the pressing device 4. Also, since the first end sections 51*a* are retracted upward, the width of the pressing device 4 does not need to be increased more than the required width (determined from the width of the material to be pressed, etc.). Therefore, the coiled material 100 and the sheet material 101 can be pressed with a compact configuration.

(3-7)

The method for controlling the pressing device 4 in this embodiment further comprises steps S10, S20, and S30 (an example of a second retraction step). In steps S10, S20, and S30, when the coiled material 100 is to be pressed, the center sections 51*c* of the bars 51 are retracted to the retracted position P10 (an example of a second retracted position) that is outside the region where the pressing is performed.

This allows the center sections 51*c* of the bar 51*s* to be retracted from the region where the pressing is performed, and the coiled material 100 can be pressed.

4. Other Embodiments

Embodiments of the present invention were described above, but the present invention is not limited to or by the above embodiments, and various modifications are possible without departing from the gist of the invention.

(A)

In the above embodiment, the lift drive mechanism 53 moves the first end sections 51*a* to the retracted position P11, but the first end sections 51*a* may instead move upward together with the box 52*a*. That is, the box 52*a*, the lift drive mechanism 53, and the clamp drive mechanism 54 may be moved in the up and down direction. Various configurations can be used for vertically moving the box 52*a*. For example, a hydraulic cylinder or a ball screw can be used.

(B)

In the above embodiment, the bars 51 move in the feed direction X, but the configuration may instead be such that the entire bars 51 do not move, and only the slide plates provided to the upper part of the bars 51 move in the feed direction X.

(C)

In the above embodiment, the box 52*b* is disposed below the second end sections 51*b*, but like the box 52*a*, the box 52*b* may be disposed above the second end sections 51*b*.

(D)

With the bar retraction mechanism 49 in the above embodiment, the bar support member 64 is configured to be capable of automatically being moved by the slide cylinder 65, but it is preferable if the bar support member 64 moves outward when a push button is operated by the user. Also, the bar support member 64 may be configured so that it can be moved manually. Also, although the feeder unit movement mechanism 5, the destacker unit movement mechanism 6, and the feeder movement mechanism 25 in the above embodiment are configured to be capable of being automatically driven by a motor, they may be manually operated.

It is preferable for an interlock to be provided if manual movement is enabled.

(E)

In the above embodiment, the coil line controller 20 of the coil line 2, the press controller 40 of the pressing device 4, and the destacker controller 30 of the destacker unit 3 are provided to the control device 9 along with the system controller 10, but the coil line controller 20, the press controller 40, and the destacker controller 30 may be provided independently. For instance, a control device may be provided for each of the coil line 2, the pressing device 4, and the destacker unit 3, and controllers may be provided in each of these control devices.

An effect of the pressing device of the present invention is that it is possible to press a coiled material and a sheet material with a compact configuration, and this invention is useful as a press system or the like having a coil line, a destacker, and the like, for example.

The invention claimed is:

1. A pressing device comprising:

a pair of bars, each of the bars including a holding section configured to hold a sheet material, a first end section separably linked to the holding section on an upstream side of the holding section along a conveyance direction of a material, and a second end section separably linked to the holding section on a downstream side of the holding section along the conveyance direction; and a first retracting mechanism that is disposed above the first end sections and configured to move the first end sections up and down in a vertical direction of the pressing device, the first retracting mechanism moving the first end sections upward to a first retracted position during pressing of a coiled material.

2. The pressing device according to claim 1, further comprising:

a slide configured to move up and down in the vertical direction;

a die clamper arranged to move together with the slide and configured to attach an upper die to a lower face of the slide; and a second retracting mechanism configured to retract the holding sections of the pair of bars to a second retracted position that is outside a working region, the working region being a region where the slide and the die clamper move during the pressing of the coiled material.

3. The pressing device according to claim 2, further comprising:

a moving bolster provided with the second retracting mechanism, the moving bolster being configured to move between a pressing position where the pressing is performed and a die replacement position where die replacement is performed, the second retracting mechanism including a support member configured to support the holding sections of the bars; and a support member movement mechanism configured to move the support member outside of the working region.

4. The pressing device according to claim 2, further comprising:

a crown disposed above the slide, the crown being configured to support the slide so that the slide is movable up and down in the vertical direction; and a plurality of uprights supporting the crown above the slide, each of the uprights having an inner face that faces inward in a width direction perpendicular to the conveyance direction and the vertical direction, the second retracted position being located farther outside the working region than the inner faces of the uprights along the width direction.

5. The pressing device according to claim 1, wherein the first retracting mechanism is a lift drive mechanism that is disposed above the first end sections, the lift drive mechanism being configured to move the first end sections of the pair of bars up and down when the sheet material is conveyed, the lift drive mechanism executing the moving of the first end sections to the first retracted position during the pressing of the coiled material.

6. The pressing device according to claim 5, wherein the first retracted position is above an uppermost position to which the lift drive mechanism moves the first end sections when the sheet material is conveyed.

7. The pressing device according to claim 1, further comprising:

a lift drive mechanism disposed above the first end section, the lift drive mechanism being configured to move the first end sections of the pair of bars up and down in the vertical direction when the sheet material is conveyed; and a clamp drive mechanism disposed above the first end section, the clamp drive mechanism being configured to move the first end sections of the pair of bars along the conveyance direction and along a width direction during the conveyance the sheet material, the width direction being perpendicular to the vertical direction and the conveyance direction, the first retracting mechanism moving the lift drive mechanism and the clamp drive mechanism upward when the first retracting mechanism moves the first end sections upward to the first retracted position during the pressing of the coiled material.

8. The pressing device according to claim 7, wherein the first retracted position is above an uppermost position to which the lift drive mechanism moves the first end sections when the sheet material is conveyed.

9. The pressing device according to claim 7, wherein the lift drive mechanism is disposed in a box, and the first retracting mechanism is configured to move the box up and down in the vertical direction.

10. A method for controlling a pressing device comprising:

moving first end sections of a pair of bars upward in a vertical direction of the pressing device to a first retracted position during pressing of a coiled material, each of the bars including a holding section configured to hold a sheet material, one of the first end sections, the first end section being separably linked to the holding section on an upstream side of the holding section along a conveyance direction of a material, and a second end section separably linked to the holding section on a downstream side of the holding section along the conveyance direction; and transmitting a signal as a trigger in order to cause a feeder to supply the coiled material to the pressing device to enter the pressing device once the moving of the first end sections is complete the moving of the first end sections to the first retracted position being executed using a first retracting mechanism that is disposed above the first end sections and configured to move the first end sections up and down in the vertical direction.

11. The method for controlling a pressing device according to claim 10, further comprising:

retracting the holding sections of the pair of bars to a second retracted position that is outside a working region where a slide and a die clamper of the pressing device move up and down in the vertical direction during the pressing of the coiled material.

12. A press system comprising:

a pressing device;

a coil line configured to supply a coiled material to the pressing device; and a destacker unit configured to supply a sheet material to the press device, the pressing device being configured to selectively press the coil material or the sheet material, and the pressing device including a pair of bars and a first retracting mechanism, each of the bars including a holding section configured to hold a sheet material, a first end section separably linked to the holding section on an upstream side of the holding section along a conveyance direction of a material, and a second end section separably linked to the holding section on a downstream side of the holding section along the conveyance direction, and the first retracting mechanism being disposed above the first end sections of the pair of bars and configured to move the first end sections up and down in a vertical direction of the pressing device, the first retracting mechanism moving the first end sections upward in the vertical direction to a first retracted position during pressing of the coiled material.

13. The press system according to claim 12, wherein the pressing device further includes a lift drive mechanism disposed above the first end section, the lift drive mechanism being configured to move the first end sections of the pair of bars up and down in the vertical direction when the sheet material is conveyed, the first retracted position is above an uppermost position to which the lift drive mechanism moves the first end sections when the sheet material is conveyed.

* * * * *